US005083336A

United States Patent [19]

Atsumi et al.

[11] Patent Number: 5,083,336

[45] Date of Patent: Jan. 28, 1992

[54] SHAVER SWEEPING BRUSH

[75] Inventors: Yukihiko Atsumi; Hiroshi Ishikawa, both of Tokyo, Japan

[73] Assignee: U.S. Philips Corp., New York, N.Y.

[21] Appl. No.: 656,926

[22] Filed: Feb. 14, 1991

[30] Foreign Application Priority Data

Feb. 21, 1990 [JP] Japan ..... 2-40053

[51] Int. Cl.[5] ..... A46B 15/00

[52] U.S. Cl. ..... 15/185; 15/160; 15/246; 30/90; 132/121; 132/289; 206/228

[58] Field of Search ..... 15/159 R, 160, 171, 15/184, 185, 246; 132/120, 121, 129, 289-292, 313; 30/90; 206/228, 351

[56] References Cited

U.S. PATENT DOCUMENTS

| | | | |
|---|---|---|---|
| 1,063,411 | 6/1913 | Brupbacher | 15/185 |
| 1,274,780 | 8/1918 | Quam | 15/184 |
| 1,641,805 | 9/1927 | Eisenberg | 132/290 |
| 2,570,412 | 10/1951 | Vogel | 15/185 |
| 2,604,649 | 7/1952 | Stephenson et al. | 15/185 |

FOREIGN PATENT DOCUMENTS

| | | | |
|---|---|---|---|
| 52386 | 6/1890 | Fed. Rep. of Germany | 15/185 |
| 832138 | 2/1952 | Fed. Rep. of Germany | 15/185 |
| 1300841 | 8/1969 | Fed. Rep. of Germany | 30/90 |
| 2451178 | 11/1980 | France | 15/185 |
| 258023 | 4/1928 | Italy | 15/185 |
| 626334 | 7/1949 | United Kingdom | 15/185 |

*Primary Examiner*—Harvey C. Hornsby
*Assistant Examiner*—Mark Spisich
*Attorney, Agent, or Firm*—Ernestine C. Bartlett

[57] ABSTRACT

A cleaning brush for a shaver is provided which comprises a substantially plate-like main member divided into a first and a second half, the first and second halves being coupled on the side of one surface by a hinge member with their side faces being substantially adjacent to each other, the first half being provided at the side face thereof with bristles extending perpendicularly to the side face, the second half being formed in a second surface thereof with a recess which opens at the side face thereof to accommodate the bristles, the cleaning brush further comprising a holding portion provided on the first and second halves and on a mounting surface, respectively, for cooperating with each other to detachably mount the main member on the mounting surface.

12 Claims, 3 Drawing Sheets

SHAVER SWEEPING BRUSH

FIELD OF THE INVENTION

The present invention relates to a portable shaver sweeping brush.

BACKGROUND OF THE INVENTION

A sweeping brush is required for sweeping the blade of a shaver and the periphery thereof after the shaver has been used.

Such a brush is preferably fitted inside of the shaver body or to the surface thereof so that it is always near at hand for the convenience of sweeping.

Representative prior art proposals for dealing with this problem described below with reference to FIGS. 8 and 9.

FIG. 8 shows a structure in which a brush containing chamber 13 is provided at the bottom of a shaver body 12 having a reciprocating blade 11 at the upper end thereof and in which a sweeping brush 15 is inserted into the chamber through an opening 14 thereof, and held in the chamber 13 when the opening is closed by a slidable bottom plate 14.

FIG. 9 shows a structure in which a part of the side wall of a protection cap 18 for covering and protecting the blade of a shaver body is cut off, a guide rail is formed at both side edges of the cut-off portion, and a sweeping brush 19 having a tab which comprises a plate member having a shape corresponding to the cut-off portion and having grooves formed at both side edges thereof so that the brush 19 is engaged and held in the cut-off portion when the tab is slid along the guide rail.

Both of the above-described methods have problems.

The method shown in FIG. 8, in which the sweeping brush is received in the shaver body, has a problem in that, since the limited internal space of the shaver, which is made compact from the viewpoint of portability, must be employed, it is difficult to obtain a sufficient space for practical use.

The device shown in FIG. 9, in which the sweeping brush is held by employing a part of the side wall of the protection cap for the shaver, has a disadvantage in that, although a sufficient space can be obtained for practical use, as seen from the drawing, the filling end of the brush is exposed to the atmosphere resulting in, the dust adhering to the brush and scattering, the filling of the brush being easily damaged. Such a structure is also aesthetically unattractive.

SUMMARY OF THE INVENTION

An object of the present invention is to resolve the above-described problems of the prior art.

To this end, the present invention provides a shaver sweeping brush comprising a main member, which has a substantially plate shape and has a first half part and a second half part, wherein the first half part and the second half part are connected by a hinge member at the flat sides thereof in a state where the side surfaces thereof are substantially brought into contact with each other; brush filling, which extends in the direction vertical to the side surface of the first half part, is provided on the side surface; a concave portion for receiving the brush filling is formed on the side surface of the second half part so as to open to the side surface; and holding means cooperating with each other are respectively provided on the other flat sides of the first and second half parts and a fitting surface for the purpose of detachably holding the main member by the fitting surface.

Since this structure permits the brush filling to be completely covered by the first half part when the sweeping brush is held, the structure has an excellent appearance. In addition, since no shaving waste adhering to the brush filling is scattered in the circumference, the sanitary aspects of the structure are excellent.

The sweeping brush can be also held by utilizing as a holding means the concave portion, which is provided on the surface of the side wall of the protection cap of the shaver, which serves as a fitting surface.

This structure permits the employment of a relatively large space and thus the formation of a sweeping brush having a size that is adequate for practical use.

Figure 1:
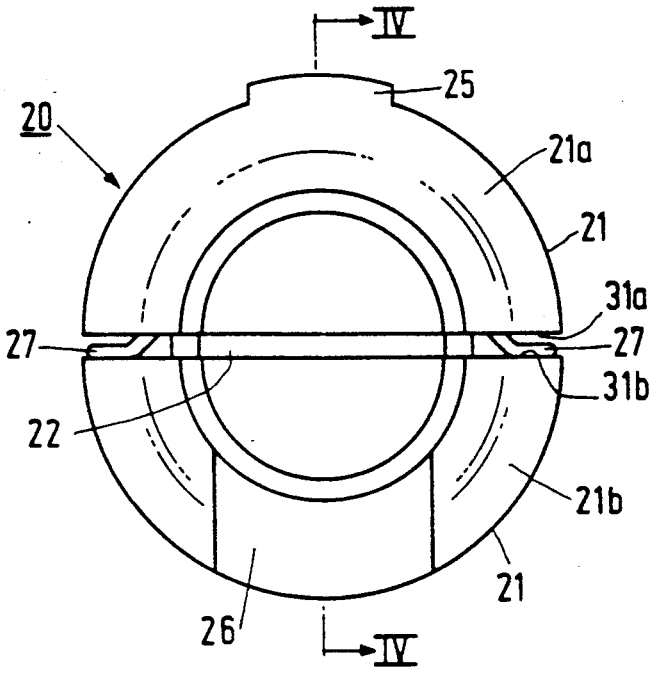
FIG. 1 is a plan view of a cleaning brush according to the invention.
Figure 2:
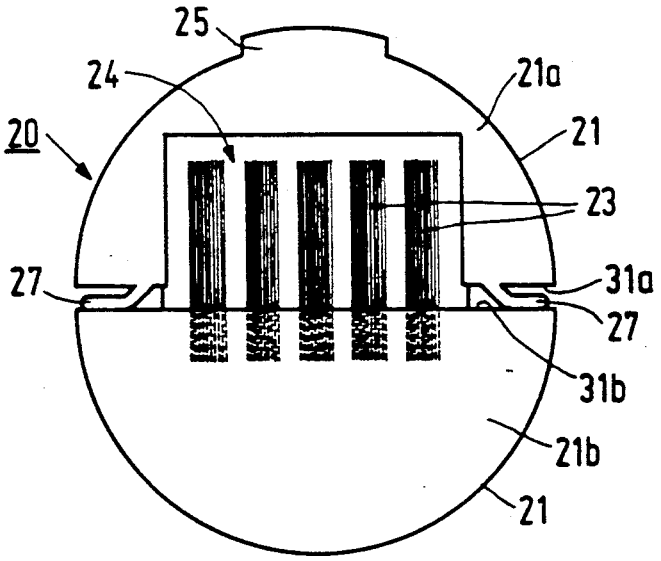
FIG. 2 is a bottom view of the cleaning brush of FIG. 1.

An embodiment of a sweeping brush in the present invention is described in detail below with reference to the drawings.

DETAILED DESCRIPTION OF THE PREFERRED EMBODIMENTS

As shown in FIGS. 1 to 4, a sweeping brush 20 of an embodiment in accordance with the present invention comprises a substantially disc-shaped member 21 which is made of a synthetic resin such as polypropylene, butadienestyrene resin or the like and which is divided into a first half part 21*a* and a second half part 21*b*, which are substantially symmetrical. Since the member 21 has a peripheral portion which is downwardly inclined in the outward direction, the member 21 has the smallest thickness at the peripheral edge thereof. The upper sides of the first half part 21*a* and the second half part 21*b* are connected to each other by a sheet-like hinge member 22. In this case, a gap at a predetermined distance is formed between the opposite side surfaces 31*a* and 31*b* of both half parts 21*a* and 21*b* so that the spring portions 27 described below can be contained therein. The hinge member 22 can be formed integrally with the first half part 21*a* and the second half part 21*b* by using the same flexible material as that of both half parts. Brush filling 23 is provided on the side surface 31*b* of the second half part 21*b*, which is opposite to the first half part 21*a*, and a concave portion 24 for receiving the brush filling 23 is formed on the lower side of the first half part 21*a* so as to open to the second half part 21*b*. A part of the periphery of the first half part 21*a*, which is at a distance from the second half part 21*b*, is horizontally extended to form a protrusion 25. The spring portions 27 are formed at both ends of the side surface 31*a* opposite to the second half part 21*b* so as to outwardly extend at a certain angle. The inclined surface of the second half part 21*b* has a concave portion 26 which is formed in a portion at a distance from the first half part 21*a* so that a finger tip can be placed therein.

Figure 3:
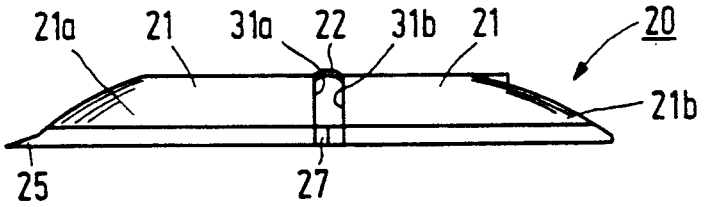
FIG. 3 is a side elevational view of the cleaning brush of FIG. 1.
Figure 4:
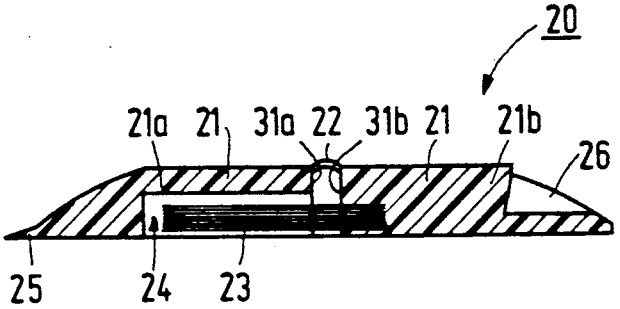
FIG. 4 is a cross sectional view of the cleaning brush taken along the line IV—IV of FIG. 1.
Figure 5:
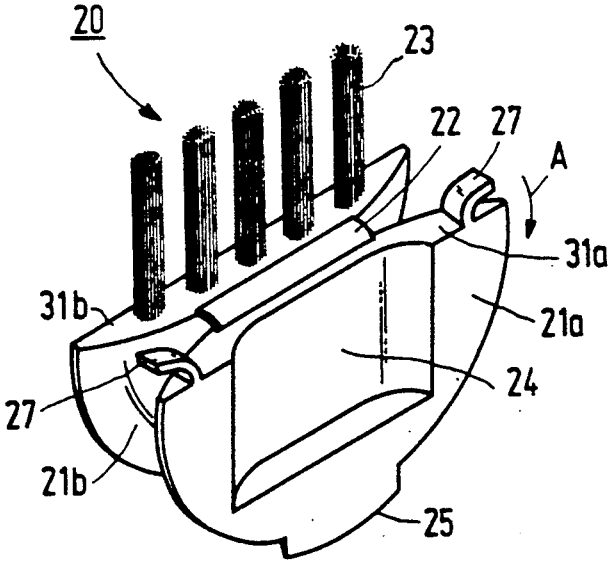
FIG. 5 is a perspective view of the cleaning brush of FIG. 1 wherein the first half of the main member is open.

When the sweeping brush 20 is not used, as seen from the FIGS. 1 and 3, the brush filling 23 is completely covered with the first half part 21*a* and thus not at all exposed to the outside. When the brush 20 is used, as shown in FIG. 5, the first half part 21*a* is rotated in the direction shown by the arrow A through the hinge member 22. In this case, the first half part 21*a* and the second half part 21*b* are used as a tab of the sweeping brush 20.

A description will now be given of the method fitting the sweeping brush 20 to the surface of the shaver.

Figure 6:
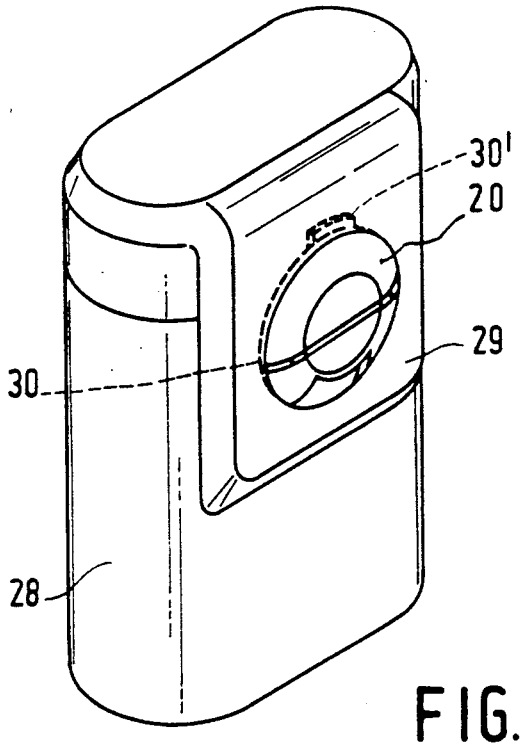
FIG. 6 is a perspective view of a shaver, having a protection cap to which the cleaning brush of FIG. 1 is fitted.

FIG. 6 shows a state where the sweeping brush 20 in accordance with the present invention is attached on a part of the surface of the side wall of a protection cap 29, which is detachably provided on the shaver body 28 for the purpose of protecting the body 28.

Figure 7:
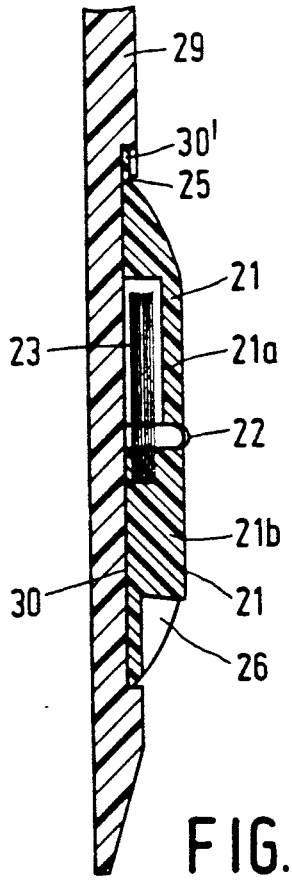
FIG. 7 is a cross sectional view of a part of the shaver with the cleaning brush.
Figure 8:
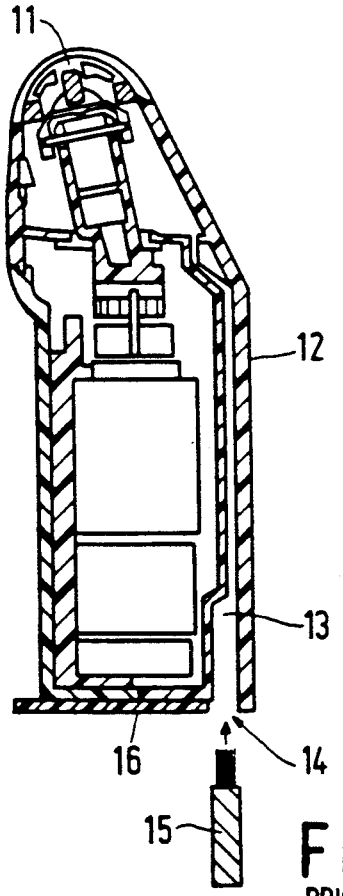
FIG.8 PRIOR ART
FIG. 8 is a cross sectional view of a prior art shaver with a conventional cleaning brush.
Figure 9:
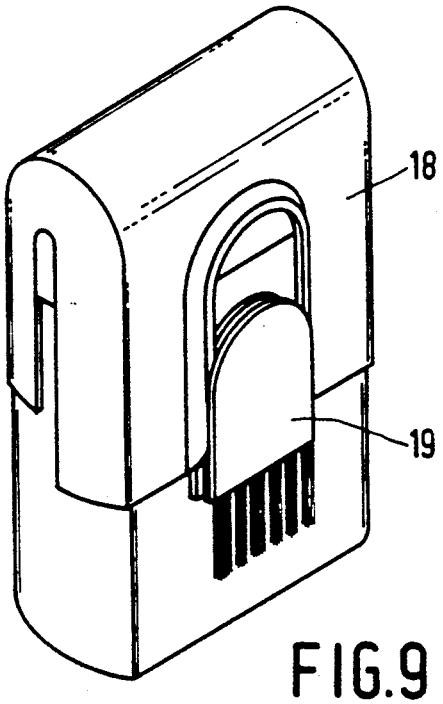
FIG.9 PRIOR ART
FIG. 9 is a perspective view of a prior art shaver with another conventional cleaning brush.

The protection cap 29 has a concave portion 30, which is provided on the surface of the side wall of the protection cap 29 and which has a circular cross-sectional shape and a substantially uniform depth in correspondence with the shape of the sweeping brush 20. The protection cap 29 also has another concave portion 30' which is provided in a part of the concave portion 30 so as to horizontally extend from the bottom of the concave portion 30 in correspondence with the protrusion 25 of the sweeping brush 20 (refer to FIG. 7). In a state where the sweeping brush 20 is fitted to the protection cap 29, the protrusion 25 is engaged with the concave portion 30' so as not to be exposed to the outside, as shown in FIG. 6 which shows the appearance of the protection cap 29.

In a state where the sweeping brush 20 is engaged with the surface of the protection cap 29, i.e., in a state where the first half part 21*a* and the second half part 21*b* are substantially on the same plane, the spring parts 27 produce elastic force so as to outwardly push both half parts 21*a*, 21*b*. The periphery of the member 21 (particularly, the second half part 21*b*) is therefore brought into pressure contact with the periphery of the concave portion 30 so that the sweeping brush 20 is tightly engaged in the concave portion 30 of the protection cap 29 and fixed therein.

The sweeping brush 20, which is fixed, can be easily removed by placing a fingertip in the concave portion 26 and separating the second half part 21*b* from the concave portion 30 against the elastic force of the spring parts 27.

Although the sweeping brush has a circular cross-sectional shape in the above-described embodiment, the cross-sectional shape may be any one of polygons such as a quadrangle, hexagon and other shapes as far as the shape has the two half parts connected to each other by a hinge structure.

Although the member 21 of the sweeping brush preferably has a peripheral portion downwardly inclined in the outward direction so that the surface is smooth when the brush is fitted to the shaver body, the member 21 need not to have an inclined surface, for example, the peripheral portion may be flat over the entire surface.

In addition, the first half part, the second half part, the hinge member and the spring part, which comprise the sweeping brush, need not be integrally formed. For example, a sheet-like flexible member, which forms the hinge member, may be fitted on the upper surfaces of the first half part and the second half part, which are separately molded, or another hinge structure may be provided.

Although the above-described embodiment concerns an example in which the sweeping brush is engaged in the concave portion provided in the protection cap, the concave portion is not limited to a part of the protection cap, and a concave portion may be provided in any portion of the surface of the shaver body as long as the concave portion allows the sweeping brush to engage therein and has adequate space. In regard to the method of holding the brush, a convex portion is provided on the bottom of each of both half parts of the sweeping brush member 21, and a concave portion is provided on the surface of the protection cap, to which the brush is fitted, so that the concave and convex portions are engaged with each other for holding the brush. A magic tape may be used for holding the sweeping brush by the fitting surface of the protection cap or the like in place of the concave and convex portions. When such a holding means is used, since there is no need for providing the spring parts, it is unnecessary to provide the gap between the opposite side surfaces of the first and second half parts.

In the preceding specification and drawings, the following numbers designate the following parts:

20: sweeping brush
21: disc-shaped member
21*a*: first half part
21*b*: second half part
22: sheet-like hinge member
23: bristles
24: concave portion
25: protrusion
26: concave portion
27: spring portion
28: shaver body
29: protection cap
30, 30': concave portions
31*a*: side face of the first half part
31*b*: side face of the second half part

We claim:

1. A cleaning brush for a shaver, said cleaning brush comprising a substantially plate-like main member divided into a first and a second half each having at least a first surface, a second surface, and a side face adjacent the first and second surfaces, the second half comprising bristles which are received substantially completely within a recess in the first half when the side faces of said first and second halves are disposed in facing relationship substantially in the same plane, said first and second halves being coupled by a hinge member on the respective side faces, said side faces being substantially adjacent to and facing each other when said first and second halves are substantially disposed in the same plane; said second half being provided at its side face with said bristles extending perpendicularly to said side face, said first half having said recess formed therein to accommodate said bristles, said cleaning brush further comprising holding means provided on said first and second halves and on a mounting surface, respectively, for cooperating with each other to detachably mount said main member on said mounting surface.

2. A cleaning brush for a shaver according to claim 1, wherein a surface of a protection cap of said shaver is utilized as said mounting surface, a recess formed in the surface of the protection cap being said holding means in which said member is fitted.

3. A cleaning brush for a shaver according to claim 2, wherein at least one of said first and second halves is provided on the side face with spring members each extending at an angle, said spring means exerting a force on each of said first and second halves whereby peripheral portions of said first and second halves are pressed against an inner peripheral surface of said recess in said protection cap.

4. A cleaning brush for a shaver according to claim 1, wherein said main member has a substantially round shape.

5. A cleaning brush for a shaver according to claim 1, wherein said hinge member is a sheet-like member which couples said first and second halves to each other on the side of said one surfaces, the sheet-like hinge member being made of a flexible resin and formed integrally with said first and second halves.

6. A cleaning brush for a shaver according to claim 1 wherein said first half is rotated about the hinge member to expose the bristles when the brush is used.

7. A cleaning brush for a shaver according to claim 1 wherein the first half and second half are substantially symmetrical.

8. A cleaning brush for a shaver which comprises a substantially plate-like main member divided into first and second substantially symmetrical halves each having at least a lower portion, an upper portion and a side face, the halves being so coupled that the respective side faces are substantially adjacent each other in a facing relationship when the two halves are substantially disposed in the same plane, the second half being provided at its side face with bristles which extend perpendicularly to the side face, the first half having a recess formed therein which substantially completely receives the perpendicularly extended bristles of the second half when the respective side faces are substantially adjacent each other in a facing relationship, said cleaning brush further comprising holding means provided on said first and second halves and on a mounting surface of a shaver, the holding means being effective to detachably mount said main member on said mounting surface so that said cleaning brush may be detached and remounted on said mounting surface.

9. A cleaning brush according to claim 8, wherein a surface of a protection cap of said shaver is utilized as said mounting surface, a recess formed in the surface of said protection cap being the holding means in which said main member is fitted.

10. A cleaning brush according to claim 9, wherein at least one of said first and second halves is provided on the side face with spring members each extending at an angle, said spring means exerting a force on each of said first and second halves whereby peripheral portions of said first and second halves are pressed against an inner peripheral surface of the recess in said protection cap.

11. A cleaning brush according to claim 8 wherein said main member has a substantially round shape.

12. A cleaning brush according to claim 8 wherein said halves are joined by a sheet-like hinge member made of a flexible resin and formed integrally with said first and second halves.

* * * * *